US005296902A

United States Patent [19]

Michlin

[11] Patent Number: 5,296,902

[45] Date of Patent: Mar. 22, 1994

[54] APPARATUS AND METHOD FOR PROVIDING A REMOVABLE SEAL BETWEEN THE TONER HOPPER AND FEED ROLLER COMPARTMENT OF A TONER CARTRIDGE ASSEMBLY

[76] Inventor: Steven B. Michlin, 5310 Bentley Suite 105, West Bloomfield, Mich. 48322

[21] Appl. No.: 908,085

[22] Filed: Jul. 6, 1992

[51] Int. Cl.[5] ..... G03G 15/06

[52] U.S. Cl. ..... 355/260; 141/364; 222/DIG. 1; 355/245; 206/527

[58] Field of Search ..... 355/260, 245, 200, 215; 141/363-366; 222/DIG. 1, 542; 206/527; 277/1, 9, 11, 12, 237 R

[56] References Cited

U.S. PATENT DOCUMENTS

| | | | |
|---|---|---|---|
| 4,495,690 | 1/1985 | McNeal | 277/11 X |
| 4,791,882 | 12/1988 | Enoguchi et al. | 118/653 |
| 4,883,017 | 11/1989 | Yuji et al. | 355/259 X |
| 4,930,684 | 6/1990 | Patterson | 222/DIG. 1 |
| 4,931,838 | 6/1990 | Ban et al. | 355/260 |
| 5,052,335 | 10/1991 | Enoguchi et al. | 355/245 X |
| 5,057,868 | 10/1991 | Sekino et al. | 355/215 |
| 5,061,963 | 10/1991 | Ikegawa et al. | 355/259 |
| 5,073,797 | 12/1991 | Ono et al. | 355/215 |
| 5,080,037 | 1/1992 | Nakagawa et al. | 355/245 X |
| 5,080,745 | 1/1992 | Paull | 355/260 X |
| 5,110,646 | 5/1992 | Prestel | 355/260 X |
| 5,150,807 | 9/1992 | Seyfried et al. | 355/260 X |
| 5,166,733 | 11/1992 | Eliason | 355/245 X |
| 5,177,540 | 1/1993 | Honda et al. | 355/260 |
| 5,184,182 | 2/1993 | Michlin | 355/260 |
| 5,212,521 | 5/1993 | Ogawa et al. | 355/215 |

FOREIGN PATENT DOCUMENTS

| | | | |
|---|---|---|---|
| 0155877 | 9/1984 | Japan | 355/215 |
| 0129664 | 6/1986 | Japan . | |
| 0185769 | 8/1986 | Japan | 355/215 |
| 0192768 | 8/1987 | Japan | 355/215 |
| 0192770 | 8/1987 | Japan | 355/215 |
| 0208073 | 9/1987 | Japan | 355/215 |
| 0209465 | 8/1989 | Japan | 355/260 |
| 0219777 | 9/1989 | Japan | 355/260 |
| 0315779 | 12/1989 | Japan | 355/260 |
| 0039763 | 2/1991 | Japan | 355/260 |
| 00200272 | 9/1991 | Japan | 355/260 |
| 0125578 | 4/1992 | Japan | 355/260 |

OTHER PUBLICATIONS

*Webster's New World Dictionary*, Third College Edition, Prentice Hall, 1988, p. 498.

*Primary Examiner*—Matthew S. Smith

[57] ABSTRACT

An apparatus and method for providing a removable closure seal between the toner hopper and the toner feed roller compartment of a toner cartridge assembly used in printers, copy machines and facsimile machines. The seal prevents toner from leaking from the toner hopper into the feed roller compartment during shipping and handling. In one embodiment, the seal has a slotted seal insert placed over the passage between the hopper and roller compartment. A removable tape closes the slot. In another embodiment, a slotted seal insert is slid between grooves in the toner cartridge assembly into position between the hopper and feed roller compartment. The insert is attached to the cartridge assembly by glue, tape, or other adhesive. An insert tool is used to facillitate this attachment. A reusable, removable closure seal is slid between the grooves to close the slot. The closure seal may have a metal spine to increase its rigidity. A crush-resistant velvet material with a foam backing is used to improve the seals at the ends of the feed roller compartment.

45 Claims, 8 Drawing Sheets

APPARATUS AND METHOD FOR PROVIDING A REMOVABLE SEAL BETWEEN THE TONER HOPPER AND FEED ROLLER COMPARTMENT OF A TONER CARTRIDGE ASSEMBLY

BACKGROUND OF THE INVENTION

This invention relates to an apparatus for providing means for re-charging and re-sealing a hollow toner hopper, which is a component of an expensive toner cartridge assembly, used in a dry toner printer, copying machine, or facsimile machine, which will permit the hopper, re-charged with dry toner, and shipped from one location to another, to avoid spilling the dry toner powder (which behaves similar to a liquid).

It has been the practice for a manufacturer of printers, copying machines, and facsimile machines to fill the toner hopper, located in the toner cartridge assembly, with dry toner, and seal closed the top of the toner hopper with a plastic sheet, attached to, and sealed on both sides and ends of the hopper, prior to assembling the toner hopper with the other components of the toner cartridge. When the toner cartridge assembly is received at the user's location, the seal is removed from the cartridge, and the printer, copier, or facsimile machine is ready for use, with the toner being exposed to the feed roller device for making copies.

Recent developments in the dry toner imaging industry have led to the use of "throw-away" type toner cartridge assemblies, whereby the user of the copier or printer must buy a new, toner cartridge assembly from the manufacturer when the original toner cartridge assembly is depleted of toner. This method of throw-away toner cartridges is very expensive to a user of the copier, facsimile machine, or printer since a new cartridge is required each time the toner hopper is depleted. The toner is expensive enough, but to add the expense of a new cartridge assembly, with its toner dispensing means, adds a substantial amount to the cost of maintenance.

It has been customary in the past to throw away these very expensive, empty toner cartridge assemblies, and replace them with new, filled, and sealed factory toner cartridge assemblies. The manufacturers seal the toner hopper components in these new toner cartridge assemblies at their manufacturing location, and there is no leakage of the toner during shipment. This type of operation, using expensive throw-away, cartridge assemblies, has led to the need for a method and apparatus for re-charging, re-sealing, shipping, and re-using these toner cartridge assemblies, with the obvious savings of the cost of the new toner cartridge assembly, and all its components, in addition to the benefits of avoiding disposal and the environmental problems created thereby.

No prior art is available for comparison to this invention, although the inventor is aware of several developments which have attempted to solve the problem and several references are cited, in applicant's earlier application Ser. No. 845,722, filed Mar. 4, 1992, which outlines the problem of dry toner usage in printers, copiers, and facsimile machines. Thus, it is obvious to a prior user of these printers and copiers that any leakage from the toner cartridge assembly creates a major cleaning problem at best, and may cause severe soiling, costly damage to the surrounding environment, in the normal accident, as well as damage to the equipment.

One such product for re-charging the dry toner hopper assembly when re-charging, uses a plastic sheet, which slides into a slot in the toner hopper section of the toner cartridge, created when the original seal has been removed.

Another product for re-sealing the dry toner in the re-charged hopper uses a plastic sheet with a magnetic coating, to try to keep the dry toner from spilling during shipment to the user. Still others try to duplicate the factory method which may require disassembly and modification of the toner hopper and thorough cleaning of the seal-grooves.

Most of the prior products, for sealing the dry toner hopper for shipment, have a major design problem. This problem centers around the long slots along the longitudinal surface of the dry toner hopper. These slots are not properly sealed along this longitudinal axis, once the original seal has been removed, leaving irregular openings along the longitudinal axis. It will be noted that the prior products of a fixed thickness slide into the uneven slot, to fill only parts of the slot length, leaving minute openings along the longitudinal axis of the toner hopper, with the resulting leakage of toner during shipment, causing major problems to both the shipper, and the receiver of the re-charged dry toner hoppers.

Another problem involves some toner hoppers that have a very narrow slot constriction that the toner seal, wider than the slot, must pull through. It is very cumbersome to seal such a toner hopper with a narrow slot constriction because the seal's width must pull through the constriction.

Another problem involves seal re-usability. In the prior art, those seal systems that are re-usable tend to leak, while those that do not leak are not re-usable. Those seal systems that use a form of sticky back tape alone as the seal, have four general problems. First, these seals may tear. Second, they may stick to toner in the slot causing them to unstick during use, not forming a perfect seal. Prevention of this requires an excessive amount of extra labor in cleaning toner from the seal-grooves each time the cartridge assembly is recharged. Third, these seal systems do not consistently seal well. A fourth problem involves foam-tearing. Many such seals that are leakproof tear the sealing foam in the hopper. The sticky tape tears the foam, then the sealing foam tears from use of the common metallic insertion tool on each usage cycle. Once this foam partially tears out, the hopper will then leak, causing the problem the seal was supposed to prevent.

One such seal of prior art, U.S. Pat. No. 5,080,745 is similar in that it uses an insertion tool to fix the removable closure seal to the hopper assembly. However, this prior patent does not disclose the use of a slotted seal insert.

Another problem with prior art is that those seals that are leakproof tend to take a substantial length of time to install, unlike the slide-in closure seal means of this invention. Those contemporary seals that are slide-seals, of the prior art, tend to leak.

SUMMARY OF THE INVENTION

Accordingly, it is an object of this invention to provide a new and improved method and apparatus for re-sealing a re-charged dry toner hopper, to permit shipment of the re-charged dry toner cartridge assemblies from one location to another, without any leakage of the toner from the hopper. A removable closure sealing device functions to eliminate leakage.

In carrying out this invention in the illustrated embodiments a flat, slotted rectangular stationary insert unit is affixed to the toner hopper, inserted in the hopper's slot groove. A second non-stationary removable and reusable rectangular closure component is placed in the same toner hopper slot, to seal the slotted stationary insert.

Thus, when the removable closure component is inserted in the slot of the recharged toner hopper, a perfect seal is achieved between the respective components. This will permit the recharged cartridge to be handled, as well as being shipped from one location to another without leakage of the toner hopper. When the slide-in closure sealing means is removed from the hopper, the slotted insert component's slot is no longer covered, and toner will fall through the slot in the top portion of the toner hopper. After toner is completely depleted and the toner hopper is re-used after re-charging, the slide-in closure sealing means may then be quickly inserted into the toner hopper's slot, and may be used again and again after re-charging. Additionally, by putting in a permanent insert, the foam in the hopper grooves will not tear.

Another closure sealing device involves an adhesive tape that seals the slotted insert with enough surface area coverage that the tape sealing means will stick, yet it will not have to cover the entire slotted insert component, to form a perfect seal. This will permit the recharged cartridge assembly to be handled, as well as shipped from one location to another without leakage of the toner hopper assembly. Two general adhesive tapes may be used. First there is the sticky adhesive family of tapes. Secondly, there is the sticky-when-hot tapes which require a heating device to apply, forming a heat-seal.

When the tape closure sealing means is pulled and thereby removed from the slotted insert in the toner hopper, the slotted insert component's slot is no longer covered, and toner will fall through the slot in the top portion of the toner hopper into the feed roller area. After the toner is completely depleted and the toner hopper is re-used after re-charging, the previously installed slotted insert component may be quickly re-used by placing new adhesive tape material over it, once again, to form a perfect seal, after re-charging.

Another object of this invention involves toner cartridge assembly leakage resulting from the feed roller ends in the feed roller compartment. After wearing, the feed roller felt-like sealant material, which allows the feed roller to turn without leakage on the ends, wears away, loses its resiliancy, as well as inelastically compressing to the point that the feed roller no longer prevents toner leakage, resulting in unwanted toner leakage. Consequently, after the original material ages and wears in time, it may be replaced with the wear-resistant sealing device of this invention to prevent toner leakage.

BRIEF DESCRIPTION OF THE DRAWING

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
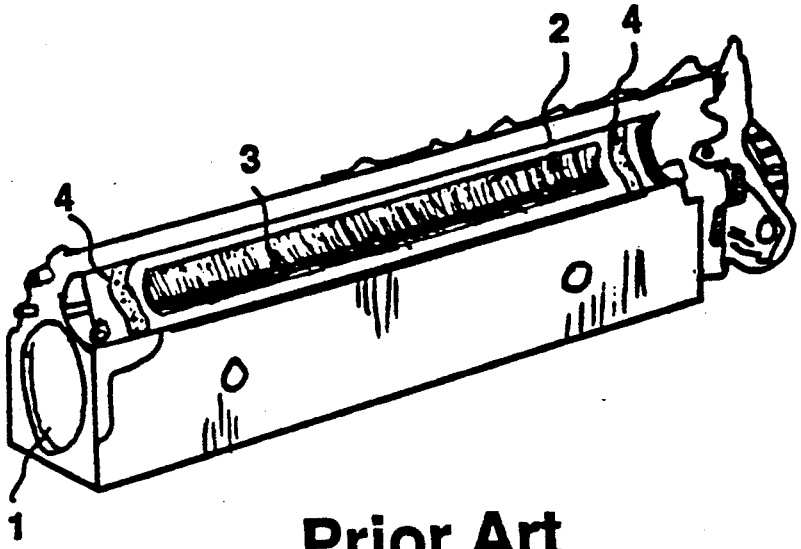
Prior Art Figure 1
FIG. 1 is an isometric view of a prior art toner hopper assembly.

Referring to FIG. 1, a prior art toner cartridge assembly is shown. For clarity in this description, the part defined as toner cartridge assembly is actually a component of the complete assembly sold to endusers. This could be, for example, the Canon LX engine cartridge. The reference numeral 1 generally refers to a dry toner hopper. There is a compartment 2 for a feed roller (not shown). A passage 3 is shown between the feed roller compartment 2 and the hopper 1. The feed roller dispenses the dry toner after it receives it from the hopper 1. Felt-like sealant material 4 is used to prevent toner leakage from the ends of the feed roller.

Figure 2:
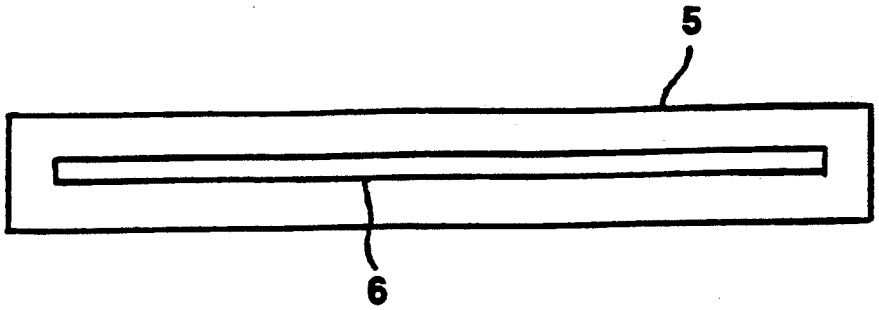
FIG. 2 is a top plan view of the slotted seal insert.
Figure 3:
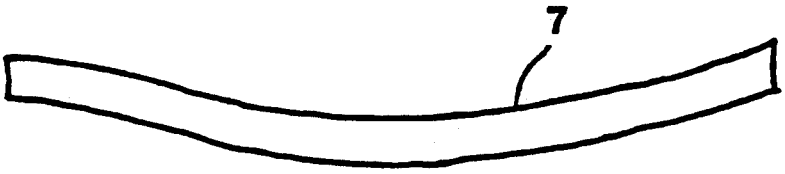
FIG. 3 is a view of the removable closure seal.

If the dry toner hopper 1 was rotated from the upright position shown, the toner would spill from the hopper through the passage 3 into the feed roller compartment 2. FIG. 2 shows a flat, rectangular seal insert 5 with a longitudinal slot The insert could be plastic, metal, or any other suitable material. FIG. 3 shows a removable closure seal Different types of adhesive tapes may be used for the closure seal, such as general adhesive tape or a sticky-when-hot tape (which requires a heating device to apply, forming a heat-seal).

Figure 4:
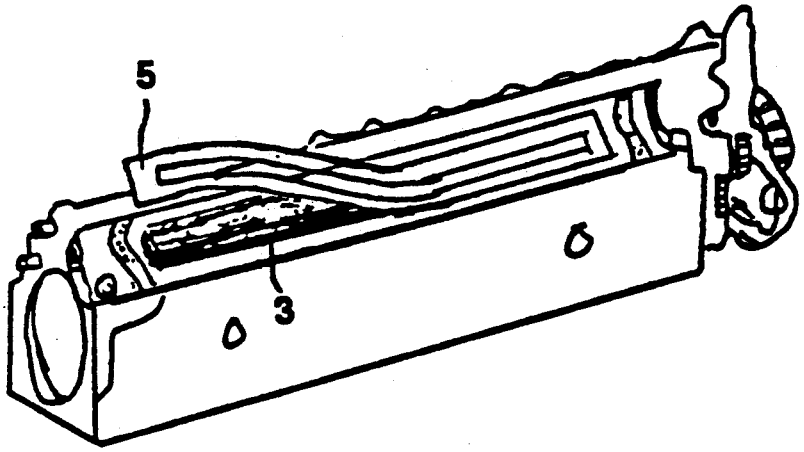
FIG. 4 is an isometric view of a prior art toner hopper assembly with the slotted seal insert being applied.
Figure 5:
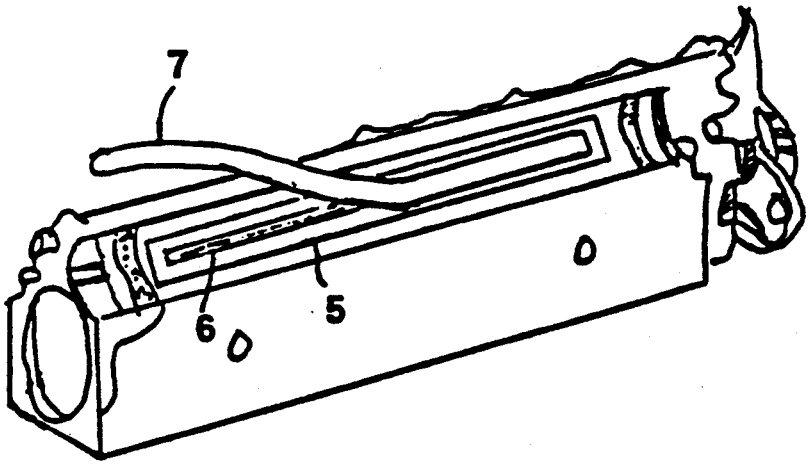
FIG. 5 is an isometric view of a prior art toner hopper assembly with the closure seal being applied over the slotted seal insert.

FIG. 4 demonstrates the slotted seal insert 5 being attached to the hopper 1 over the passage 3, such that the slot and passage generally align. As shown in FIG. 4, the perimeter of surrounding area of the passage 3 forms a ledge between the hopper 1 and the feed roller compartment 2. The seal insert 5 could be attached to this ledge by tape, glue, caulk, etc. This makes the attachment semi-permanent. In Figure 5, the removable closure seal 7 is placed over the slotted seal insert 5 and stuck to it. The removable closure seal 7 is slightly larger than the slot 6 in the seal insert 5. The slotted seal insert 5 in this embodiment would be located between the removable closure seal 7 and the toner hopper 1. A re-charged cartridge assembly may now be handled and shipped without fear of leakage from the toner hopper.

Figure 6:
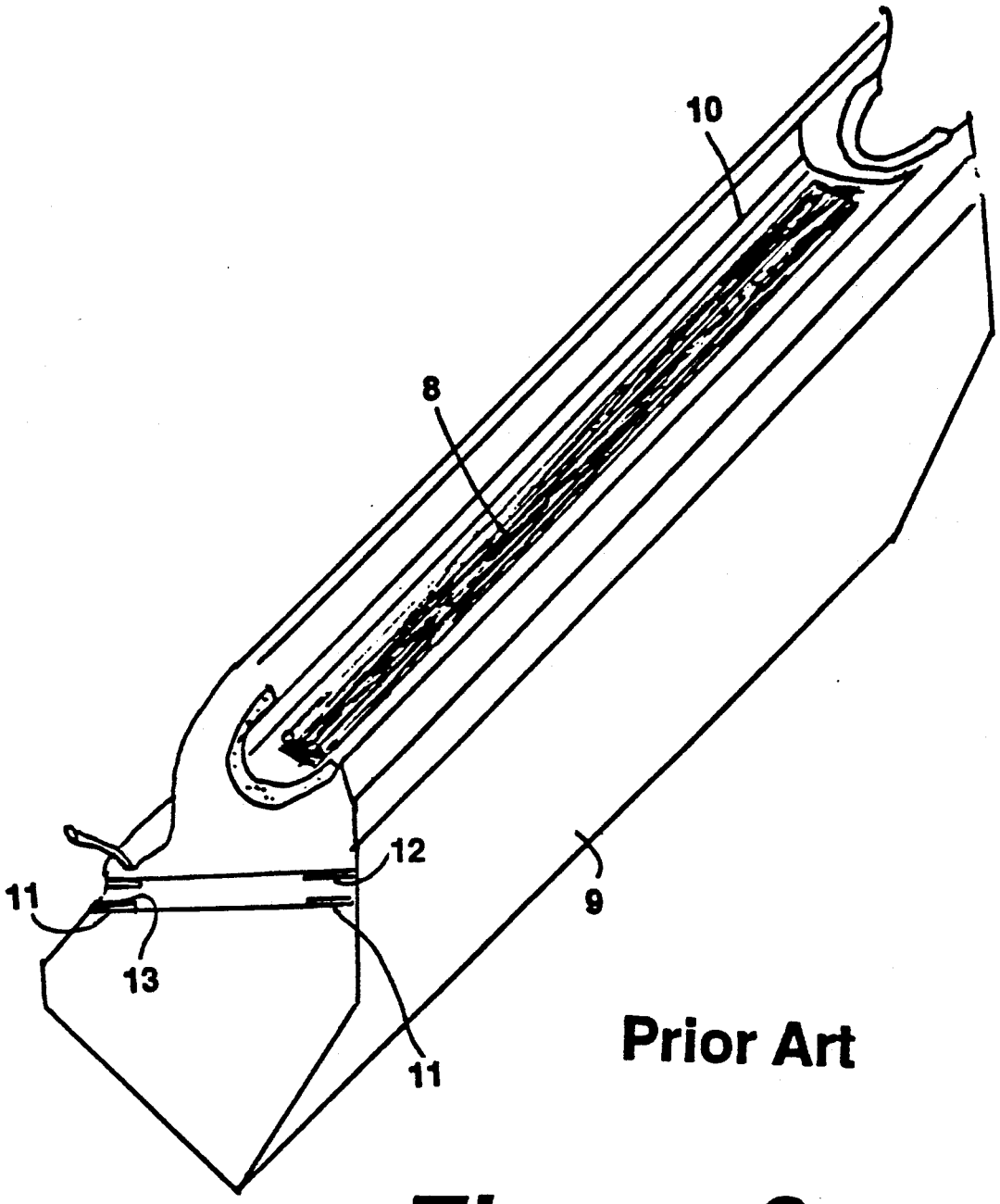
Prior Art Figure 6
FIG. 6 is an isometric view of another prior art toner hopper assembly.

FIG. 6 shows a different toner cartridge assembly with a wider passage 8 between the toner hopper 9 and the feed roller compartment 10. This could be, for example, a Canon SX Cartridge. The second embodiment of this invention is directed toward this type of cartridge assembly. There is a longitudinal groove on each side of the hopper 9 extending the length of the hopper. Each groove 11 has an upper ridge or surface 12 and a lower ridge or surface 13.

Figure 7:
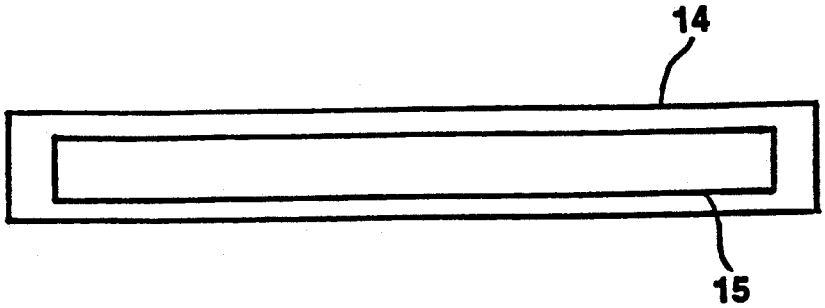
FIG. 7 is a top plan view of a second slotted seal insert.
Figure 8:
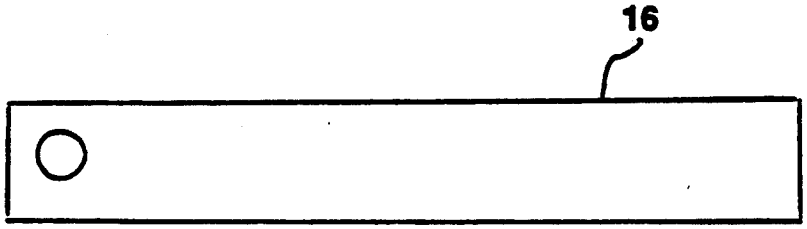
FIG. 8 is a top plan view of an insert tool.

FIG. 7 shows a flat, rectangular seal insert 14 with a wide longitudinal slot 15 designed to fit over the passage 8 in the cartridge assembly. The seal insert may be plastic, metal, or any other suitable material. The slotted seal insert 14 is slid from an opening at the end of the cartridge assembly through the grooves 11 into position over the passage opening 8 between the hopper 9 and the feed roller compartment 10. The slot 15 in the seal insert will correspond with the passage 8 in the cartridge assembly. The slotted seal insert 14 can be attached to either the upper or lower ridge of each groove 11 by several means. The slotted seal insert 14 could be glued or caulked to the cartridge assembly when the seal insert is pressed against either the upper 12 or lower ridges 13 of the grooves 11. This prevents glue or caulk, etc. from migrating into the slot. FIG. 8 shows an insert tool 16. It is a flat, rectangular piece of metal or rigid plastic which can be slid into the grooves 11 on either side of the slotted seal insert 14. The purpose of this insert tool 16 is to press the slotted seal insert 14 against the lower or upper ridges of the grooves 11 to fix the slotted seal insert tightly against the ridges until the glue, caulk, etc. dries and holds to prevent glue or caulk migration.

Figure 9:
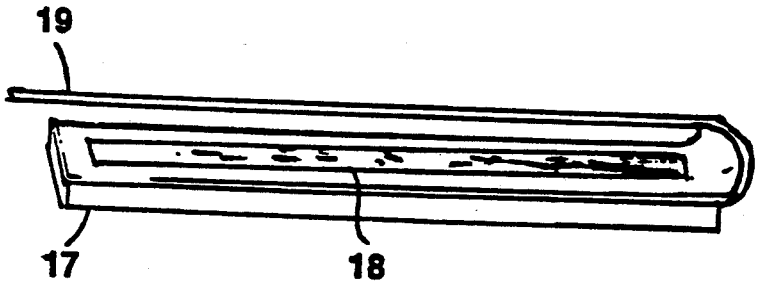
FIG. 9 is an isometric view of a two-sided tape with extended backing and longitudinal slot.

Another method of fixing the slotted seal insert 14 to the cartridge assembly would be through the use of two-sided tape. FIG. 9 shows a piece of two-sided tape 17 with a slot 18 cut into it corresponding in size to the slot 15 in the seal insert 14, and wherein the tape is slightly wider than the slot. One side of the tape is adhered to the slotted seal insert so the slot in the tape and seal insert match. The backing 19 on the other side of the tape 17 is over twice the length of the slotted seal insert. The tape on the extra length of backing (beyond the length of the seal insert) is removed from the backing 19 and the backing is doubled back over the length of the seal insert 14 and hangs over the edge. When the slotted seal insert 14 is slid into position between the hopper 9 and feed roller compartment 10, the backing 19 of the tape 17 hangs out from the grooves 11. The backing is then pulled out from the grooves, exposing the other adhesive side of the tape. The slotted seal insert 14, covered by the slotted two-sided tape, is then pressed against the upper or lower ridges of the grooves 11 (depending on which side of the slotted seal insert the tape is attached to) by the insert tool 16 to attach the slotted insert seal to the cartridge assembly.

Figure 10:
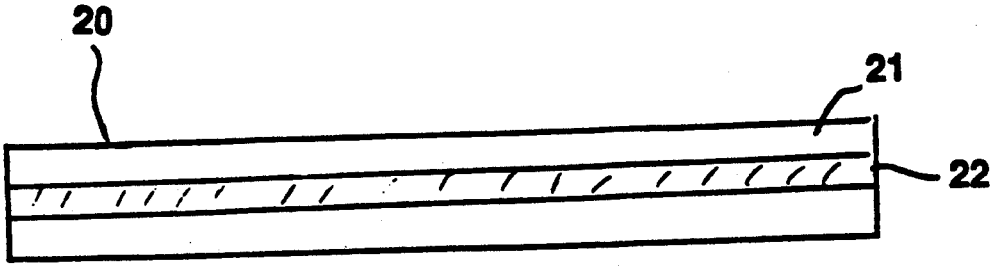
FIG. 10 is a top plan view of a second removable closure seal.

FIG. 10 shows the removable closure seal 20 of the embodiment. A flat, rectangular plastic seal piece 21 is provided with a metal spine 22 to make the removable closure seal rigid. Of course, the entire removable closure seal may be rigid plastic, metal, or any other rigid, suitable material. In use the spine 22 would be located on the side of the removable closure seal opposite the seal insert so the closure seal and the seal insert are in complete contact. The removable closure seal is slid after the insert tool has been removed into position between the toner hopper 9 and feed roller compartment 10, covering the slot in the slotted seal insert 14. This could be between the feed roller compartment 10 and the slotted seal insert 14 or between the toner hopper 9 and the slotted seal insert, depending on whether the slotted seal insert 14 is fixed to the upper or lower ridges of the grooves 11. The insert tool 16 has to be removed before sliding the removable closure seal 20 into its proper location so there is enough clearance in the groove for the closure seal.

Figure 11:
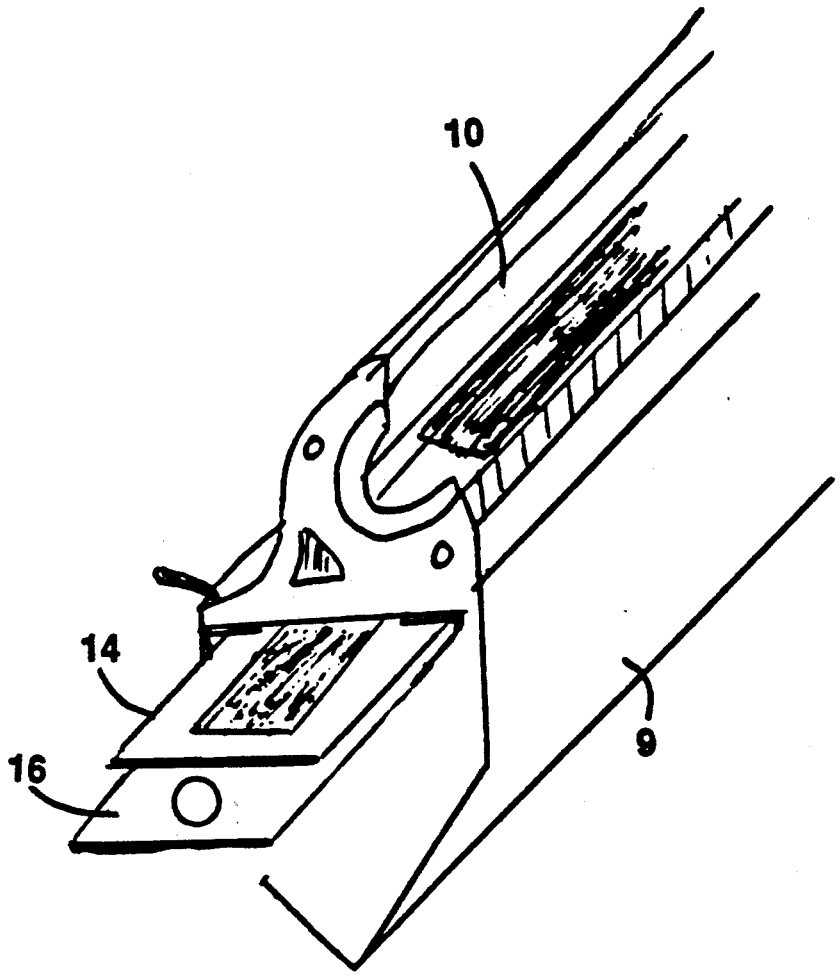
FIG. 11 is an isometric view of a prior art toner hopper demonstrating the seal insert being placed in position.
Figure 12:
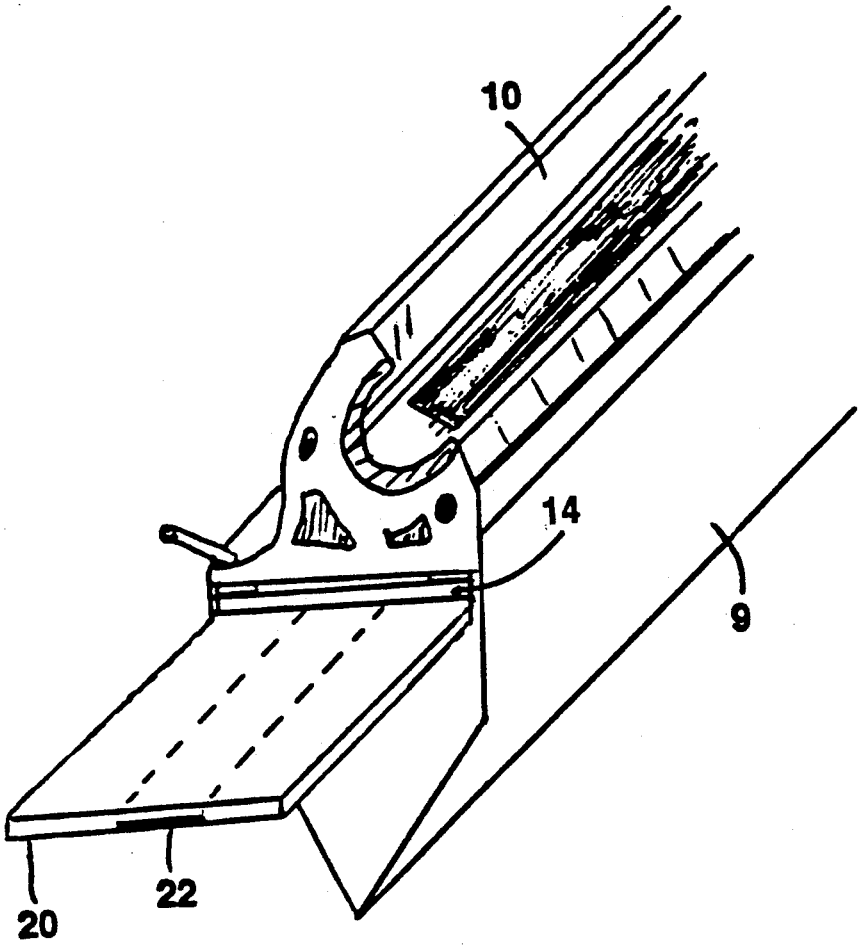
FIG. 12 is an isometric view of the second prior art toner hopper demonstrating the seal insert and the slide seal in position.

FIG. 11 demonstrates a possible position of the slotted seal insert 14 when the insert tool 16 is used to press it against the groove and the seal insert becomes fixed to the assembly. The insert tool would then be removed (after the adhesive dries or holds). The removable closure seal 20 would then be slid through the grooves of the toner cartridge assembly into location between the hopper 9 and feed roller compartment 10 closing the slot in the slotted seal insert. This is represented in FIG. The cartridge assembly may then be transported without fear of toner leakage out of the toner hopper.

Figure 13:
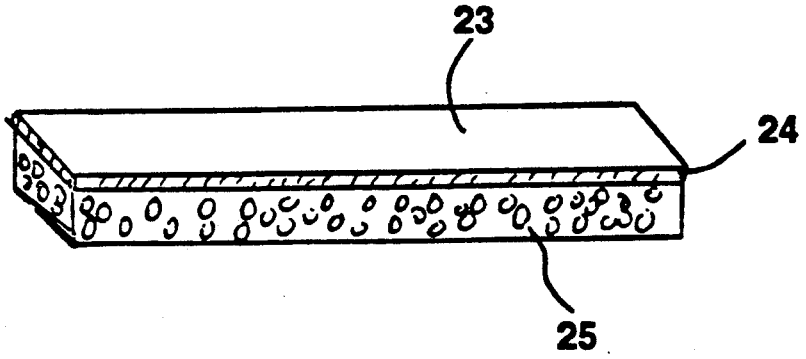
FIG. 13 is an isometric view of the feed roller compartment end seals.

FIG. 13 shows a crush-resistant velvet material 23 with sewn edges 24 attached to a foam backing 25. The foam backing may be two-sided foam tape, or the foam backing may be glued, etc to the velvet material. A company called Offray Designer Ribbons makes a product entitled "Woven-Edge Ribbon (Pattern 4031)" which is a crush-resistant velvet material with sewn edges. It is backed by a two-sided foam tape or otherwise attached foam material. Where prior art uses only a rigid stiff non-resiliant material, the resiliency of the foam is one important feature of this invention. The foam backing works well with other crush resistant materials than velvet, but this foam is a very important improvement made in this invention for improved longevity and performance. This product may be used in this embodiment of the invention. This material has been found to be an excellant, wear-resistant replacement for the felt-like seals 4 at the feed roller ends of the toner cartridge assembly (see FIG. 1). The velvet can be taped or glued, etc into position and will prevent toner leakage from the ends of the feed roller when the toner cartridge assembly is in operation.

What is claimed is:

1. A seal used to permit the re-charging of a toner cartridge assembly used in printers, copy machines, and facsimile machines and prevent the loss of toner from said cartridge assembly during handling and shipment, said cartridge assembly including a toner hopper and a feed roller compartment, said seal comprising a slotted seal insert semi-permanently attached to the toner hopper by joining means, said joining means comprising grooves or a ledge on the cartridge assembly between said toner hopper and said feed roller compartment for receiving said slotted seal insert, said slotted seal insert is semi-permanently affixed to said grooves of said ledge of said assembly into a position between said toner hopper and said feed roller compartment, said seal further including a removable closure sealing means for covering the slot in the slotted seal insert.

2. A seal as in claim 1 wherein the removable closure sealing means is a strip of tape slightly wider than the slot in the slotted seal insert.

3. A seal as in claim 2, wherein the tape is of the heat-seal type so that, when heated, it will adhere to the slotted seal insert, closing the slot and preventing the leakage of toner from said toner hopper to said feed roller compartment.

4. A seal as in claim 1 wherein the slotted seal insert is flat and rectangular.

5. A seal as in claim 1 wherein said slotted seal insert is positioned between said removable closure sealing means and said toner hopper.

6. A seal as in claim 1 wherein said grooves have upper and lower ridges, said slotted seal-insert is slid between said upper and lower ridges of said grooves, and said removable closure sealing means comprises a seal piece also slit between said upper and lower ridges of said grooves into position between said hopper and said feed roller compartment and covering said slot in said slotted seal-insert.

7. A seal as in claim 6 wherein said seal piece is flat and rectangular.

8. A seal as in claim 8 wherein said piece comprises a flat, plastic seal with a flat metal spine for rigidity.

9. A seal as in claim 6 wherein said seal piece is positioned between the slotted seal insert and said toner hopper.

10. A seal as in claim 6 wherein said seal piece is positioned between the slotted seal insert and said feed roller compartment.

11. A seal as in claim 6 wherein said slotted seal insert is affixed by attachment means to either said upper or lower ridges of said grooves.

12. A seal as in claim 11 wherein said attachment means is glue, caulk, or other like means.

13. A seal as in claim 11 wherein said attachment means of said seal insert is a two-sided tape with a slot corresponding to said slot in said slotted seal insert.

14. A seal as in claim 1 wherein said slotted seal insert is semi-permanently affixed to said grooves or said ledge by glue, caulk or other like means.

15. A seal as in claim 1 wherein said slotted seal insert is semi-permanently affixed to said grooves or said ledge by tape.

16. A seal for preventing toner leakage from a feed roller compartment in a toner cartridge assembly, said feed roller compartment having two ends, said seal comprising a velvet material attached at each end of said feed roller compartment for preventing leakage of toner from said ends of said feed roller compartment.

17. A seal as in claim 16 wherein a resilient foam backing is applied to the velvet material to increase the resiliency of said seal.

18. A seal as in claim 17 wherein said foam backing is a two-sided foam tape.

19. A seal as in claim 17 wherein said foam backing is glued to said velvet material.

20. A seal for preventing toner leakage from a feed roller compartment in a toner cartridge assembly, said feed roller compartment having two ends, said seal comprising a crush-resistant material attached at each end of said feed roller compartment for preventing leakage of toner from said ends of said feed roller compartment, said crush-resistant material having sides sewn to prevent unraveling.

21. A seal as in claim 20 wherein a resilient foam backing is applied to the crush-resistant material to increase the resiliency of said seal.

22. A seal as in claim 21 wherein said foam backing is a two-sided foam tape.

23. A seal as in claim 20 wherein said crush-resistant material is velvet.

24. A method of placing a seal between a toner hopper and a toner feed roller compartment in a toner cartridge assembly for permitting the recharging of toner used in printers, copy machines and facsimile machines for preventing leakage of toner from said hopper to said feed roller compartment during shipping and handling, said toner cartridge assembly having grooves located between said toner hopper and said toner feed roller compartment, said grooves each having upper and lower ridges, said method comprising the steps of sliding a slotted seal insert and a removable closure sealing means between said upper and lower ridges of said grooves in said cartridge assembly into position between said hopper and said feed roller compartment, permanently affixing said slotted seal insert to said grooves, and using said removable closure sealing means to cover the slot in said slotted seal insert and close off the toner passage between said hopper and said feed roller compartment.

25. A method as in claim 24 wherein the slotted seal insert is attached to the upper or lower ridges of said grooves of said toner cartridge assembly by glue, caulk, or like means after said slotted seal insert has been formed tightly against said upper or lower ridges of said grooves.

26. A method as in claim 25, wherein an insert tool is slid into said grooves to press the slotted seal insert against said upper or lower ridges of said grooves and cause the slotted seal insert to adhere to said upper or lower ridges of said grooves.

27. A method as in claim 26 wherein the insert tool is removed and the removable closure sealing means is slid into a clearance space left open by the insert tool closing said slot in said slotted seal insert.

28. A method as in claim 24 wherein said slotted seal insert is attached to the upper or lower ridges of said grooves by using a two-sided tape with backing on one side, wherein said two-sided tape is slotted and adhered to the slotted seal insert such that the slots correspond said two-sided tape having tape adhesive and said backing is over twice as long as said slotted two-sided tape and doubled back over said tape such that said backing hangs out from said grooves when said slotted seal insert is slid into said grooves, and then said backing is pulled from said grooves to expose the tape adhesive to the upper or lower ridges of said grooves, whereby the slotted seal insert is joined to either the upper or lower ridges of said grooves.

29. A method as in claim 28 wherein an insert tool is slid into said grooves to press the slotted seal insert against said upper or lower ridges of said grooves and cause the slotted seal insert to adhere to said upper or lower ridges of said grooves.

30. A method as in claim 29 wherein the insert tool is removed and the removable closure sealing means is slid into the clearance space left open by the insert tool closing said slot in said slotted seal insert.

31. A seal used to permit the re-charging of a toner cartridge assembly used in printers, copy machines, and facsimile machines and prevent the loss of toner from said cartridge assembly during handling and shipment, said cartridge assembly including a toner hopper and a feed roller compartment, said seal comprising a slotted seal insert attached to the toner hopper by joining means, said joining means comprising grooves on the cartridge assembly between said toner hopper and said feed roller compartment for receiving said slotted seal insert, said grooves having upper and lower ridges, wherein both of said ridges provide support for the slotted seal insert, whereby said slotted seal insert is slid between said upper and lower ridges of said grooves into position between said toner hopper and said feed roller compartment, said seal further including a removable closure sealing means for covering the slot int he slotted seal insert.

32. A seal as in claim 31 wherein the removable closure sealing means is a strip of tape slightly wider than the slot in the slotted seal insert.

33. A seal as in claim 32, wherein the tape is of the heat-seal type so that, when heated, it will adhere to the slotted seal insert, closing the slot and preventing the leakage of toner from said toner hopper to said feed roller compartment.

34. A seal as in claim 31 wherein the slotted seal insert is flat and rectangular.

35. A seal as in claim 31 wherein said slotted seal insert is positioned between said removable closure sealing means and said toner hopper.

36. A seal as in claim 31 wherein said grooves have upper and lower ridges, said slotted seal-insert is slid between said upper and lower ridges of said grooves, and said removable closure sealing means comprises a seal piece also slid between said upper and lower ridges of said grooves into position between said hopper and said feed roller compartment and covering said slot in said slotted seal-insert.

37. A seal as in claim 36 wherein said seal piece is flat and rectangular.

38. A seal as in claim 37 wherein said piece comprises a flat, plastic seal with a flat metal spine for rigidity.

39. A seal as in claim 36 wherein said seal piece is positioned between the slotted seal insert and said toner hopper.

40. A seal as in claim 36 wherein said seal piece is positioned between the slotted seal insert and said feed roller compartment.

41. A seal as in claim 36 wherein said slotted seal insert is affixed by attachment means to either said upper or lower ridges of said grooves.

42. A seal as in claim 41 wherein said attachment means is glue, caulk or other like means.

43. A seal as in claim 41 wherein said attachment means of seal insert is a two-sided tape with a slot corresponding to said slot in said slotted seal insert.

44. A seal for preventing toner leakage from a feed roller compartment in a toner cartridge assembly, said feed roller compartment having two ends, said seal comprising a crush-resistant material attached at each end of said feed roller compartment for preventing leakage of toner from said ends of said feed roller compartment, said crush-resistant material including a two-sided foam tape backing to increase the resiliency of said seal.

45. A seal as in claim 44 wherein said crush-resistant material is velvet.

* * * * *

US005296902C1

(12) REEXAMINATION CERTIFICATE (4652nd)

United States Patent

Michlin

(10) Number: US 5,296,902 C1

(45) Certificate Issued: Oct. 8, 2002

(54) APPARATUS AND METHOD FOR PROVIDING A REMOVABLE SEAL BETWEEN THE TONER HOPPER AND FEED ROLLER COMPARTMENT OF A TONER CARTRIDGE ASSEMBLY

(75) Inventor: Steven B. Michlin, 5310 Bentley Suite 105, West Bloomfield, MI (US) 48322

(73) Assignee: Steven B. Michlin, West Bloomfield, MI (US)

Reexamination Request:
No. 90/005,738, Jun. 12, 2000

Reexamination Certificate for:

| | |
|---|---|
| Patent No.: | **5,296,902** |
| Issued: | **Mar. 22, 1994** |
| Appl. No.: | **07/908,085** |
| Filed: | **Jul. 6, 1992** |

(21) Appl. No.: 07/908,085

(51) Int. Cl.[7] ..... G03G 15/06

(52) U.S. Cl. ..... 399/109; 141/364; 206/527; 399/106

(58) Field of Search ..... 399/102, 103, 399/105, 106, 109; 141/363–366; 222/542, DIG. 1; 296/527

(56) References Cited

U.S. PATENT DOCUMENTS 4,706,320 A 11/1987 Swift ..... 15/1.5 R

FOREIGN PATENT DOCUMENTS

JP 62-137453 8/1987

JP 2-140553 11/1990

JP 3-44688 2/1991

OTHER PUBLICATIONS

"Webster's New World Dictionary, Third College Edition", 1988, p. 1480, definition 1 for "Velvet".*

"Textile Terms and Definitions, Fifth Edition," *The Textile Institute*, Aug., 1963. pp. 102,165–166, description of velvet.

"Websters Ninth Collegiate Dictionary", 1990, p. 1307, highlighted definition of "velvet".

* cited by examiner

*Primary Examiner*—William J Royer

(57) ABSTRACT

An apparatus and method for providing a removable closure seal between the toner hopper and the toner feed roller compartment of a toner cartridge assembly used in printers, copy machines and facsimile machines. The seal prevents toner from leaking from the toner hopper into the feed roller compartment during shipping and handling. In one embodiment, the seal has a slotted seal insert placed over the passage between the hopper and roller compartment. A removable tape closes the slot. In another embodiment, a slotted seal insert is slid between grooves in the toner cartridge assembly into position between the hopper and feed roller compartment. The insert is attached to the cartridge assembly by glue, tape, or other adhesive. An insert tool is used to facillitate this attachment. A reusable, removable closure seal is slid between the grooves to close the slot. The closure seal may have a metal spine to increase its rigidity. A crush-resistant velvet material with a foam backing is used to improve the seals at the ends of the feed roller compartment.

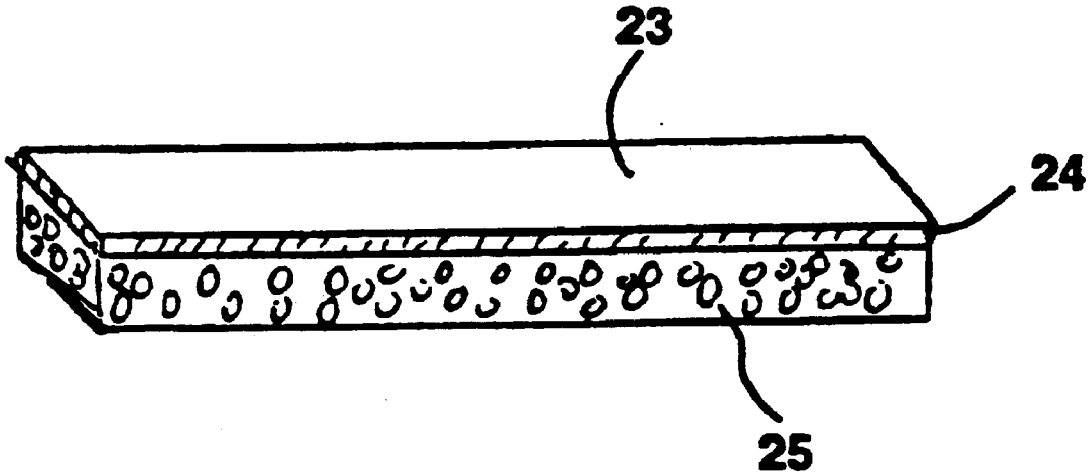

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 6, lines 15–36:

FIG. 13 shows a crush-resistant velvet material 23 with sewn edges 24 attached to a foam backing 25. The foam backing may be two-sided foam tape, or the foam backing may be glued, etc to the velvet material. A company called Offray Designer Ribbons makes a product entitled "Woven-Edge Ribbon (Pattern 4031)" which is a crush-resistant velvet material with sewn edges. [It] *The crush-resistant velvet material 23* is backed by a two-sided foam tape or otherwise attached foam material. Where prior art uses only a rigid stiff non-resilient material, the resilency of the foam is one important feature of this invention. The foam backing works well with other crush resistant materials than velvet, but this foam is a very important improvement made in this invention for improved longevity and performance. This product may be used in this embodiment of the invention. This material has been found to be an excellent, wear-resistant replacement for the felt-like seals 4 at the feed roller ends of the toner cartridge assembly (see FIG. 1). The velvet can be taped or glued, etc into position and will prevent toner leakage from the ends of the feed roller when the toner cartridge assembly is in operation.

AS A RESULT OF REEXAMINATION, IT HAS BEEN DETERMINED THAT:

The patentability of claims 1–15 and 20–45 is confirmed.

Claim 17 is cancelled.

Claims 16, 18 and 19 are determined to be patentable as amended.

New Claims 46–50 are added and determined to be patentable.

16. A seal for preventing toner leakage from a feed roller compartment in a toner cartridge assembly, said feed roller compartment having two ends, said seal comprising a velvet material attached at each end of said feed roller compartment for preventing leakage of toner from said ends of said feed roller compartment, *said seal including a resilient foam backing applied to the velvet material to increase the resiliency of said seal.*

18. A seal as in claim [17] *16* wherein said foam backing is a two-sided foam tape.

19. A seal as in claim [17] *16* wherein said foam backing is glued to said velvet material.

*46. A seal for preventing toner leakge from a feed roller compartment in a toner cartridge assembly,*

*said feed roller compartment having two ends,*

*said seal comprising a crush-resistant velvet material attached at each end of said feed roller compartment for preventing leakage of toner from said ends of said feed roller compartment.*

*47. A seal for preventing toner leakage from a feed roller compartment in a toner cartridge assembly,*

*said feed roller compartment having two ends,*

*said seal comprising a velvet material attached at each end of said feed roller compartment for preventing leakage of toner from said ends of said feed roller compartment;*

*wherein a resilient foam backing is applied to said velvet material to increase the resiliency of said seal.*

*48. A seal for preventing toner leakage from a feed roller compartment in a toner cartridge assembly,*

*said feed roller compartment having two ends,*

*said seal comprising a crush-resistant velvet material attached at each end of said feed roller compartment for preventing leakage of toner from said ends of said feed roller compartment;*

*wherein a resilient foam backing is applied to said crush-resistant velvet material to increase the resiliency of said seal.*

*49. A seal for preventing toner leakage from a feed roller compartment in a toner cartridge assembly,*

*said feed roller compartment having two ends,*

*said seal comprising a velvet material attached at each end of said feed roller compartment for preventing leakage of toner from said ends of said feed roller compartment;*

*wherein a resilient backing is applied to said velvet material to increase the resiliency of said seal.*

*50. A seal for preventing toner leakage from a feed roller compartment in a toner cartridge assembly,*

*said feed roller compartment having two ends,*

*said seal comprising a crush-resistant velvet material attached at each end of said feed roller compartment for preventing leakage of toner from said ends of said feed roller compartment;*

*wherein a resilient backing is applied to said crush-resistant velvet material to increase the resiliency of said seal.*

* * * * *